US007152662B2

(12) United States Patent
Yu

(10) Patent No.: US 7,152,662 B2
(45) Date of Patent: Dec. 26, 2006

(54) METHOD OF PREVENTING CRACKING IN DIRECT CHILL CAST INGOTS

(75) Inventor: Ho Yu, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 552 days.

(21) Appl. No.: 10/630,387

(22) Filed: Jul. 30, 2003

(65) Prior Publication Data

US 2005/0022962 A1 Feb. 3, 2005

(51) Int. Cl.
*B22D 11/124* (2006.01)

(52) U.S. Cl. ..... 164/487; 164/444

(58) Field of Classification Search ..... 164/485–487, 164/443–444

See application file for complete search history.

(56) References Cited

U.S. PATENT DOCUMENTS 4,071,072 A 1/1978 McCubbin ..... 164/89
5,148,853 A * 9/1992 Yu et al. ..... 164/455
6,066,403 A 5/2000 Sherwood et al. ..... 428/472.3
6,572,789 B1 * 6/2003 Yang et al. ..... 252/389.23

* cited by examiner

*Primary Examiner*—Kuang Y. Lin
(74) *Attorney, Agent, or Firm*—Greenberg Traurig, LLP; Peter J. Borghetti

(57) ABSTRACT

A method of casting a metal ingot having the steps of delivering molten metal to a direct chill mold, forming a solidified shell of metal, applying a coolant to a surface of the shell as it emerges from the mold, and withdrawing a solidified ingot from the mold. The coolant contains an oxidation inhibitor for increasing the rate of heat transfer from the solidifying metal compared to a coolant not containing the oxidation inhibitor to produce an ingot which is resistant to cracking.

9 Claims, 4 Drawing Sheets

METHOD OF PREVENTING CRACKING IN DIRECT CHILL CAST INGOTS

BACKGROUND OF THE INVENTION

1. Field of the Invention

The present invention is directed to a method for reducing or preventing cracking of direct chill cast ingots, more particularly to a method of direct chill casting using a coolant containing an oxidation inhibitor.

2. Prior Art

Ingots of light metal alloys such as aluminum alloys and magnesium alloys may be produced by direct chill (DC) casting. In conventional DC casting, molten metal is poured into an open-ended mold. The lower end of the mold is initially closed by a platform referred to as a bottom block, and the molten metal pools within the mold. The bottom block is progressively lowered in step with the pouring of the molten metal. The walls of the DC mold are continuously cooled so that a solid skin of metal forms in contact with the mold wall at the level of the surface of the pool of molten metal in the mold. Water is typically used as the coolant for applying to the surface of solid skin that forms in contact with the mold wall. An example of a method of DC casting is described in U.S. Pat. No. 4,071,072, incorporated herein by reference.

It is well established that the tendency of DC cast ingots to cracking is dependent in part on the ingot cooling rate. A high cooling rate increases the ingot shell thickness and strength as the ingot solidifies and thereby lowers the ingot cracking tendency. Attempts to solve the problems of ingot cracking have focused on the ingot casting practice itself to reduce the stresses within the ingots. However, consistent low cracking results have been unachievable to date due to the difficulty in controlling all critical cracking parameters simultaneously. Ingot cracking remains a major recovery problem in ingot production. This problem is particularly severe in high strength alloys such as aluminum alloys used in the aerospace industry.

Accordingly, a need remains for a method of casting metal in a direct chill mold in which the ingot cracking tendency is reduced.

SUMMARY OF THE INVENTION

This need is met by the method of casting a metal ingot according to the present invention. According to the method, molten metal is delivered to a direct chill mold, a solidified shell of metal is formed and a coolant is applied to the surface of the shell as it emerges from the mold and the solidified ingot can move from the mold. The invention includes modifying the ingot surface to increase the cooling rate of the ingot. The ingot surface may be modified by applying an oxidation inhibitor to the coolant fluid. In DC casting of aluminum alloys, the application of an aqueous coolant containing an oxidation inhibitor decreases the rate of which aluminum oxide is produced. The reduction in the thickness of the oxide on the surface of the ingot and the modification of the ingot surface condition increase the cooling rate of the ingot, which, in turn, reduces the tendency for cracking by the ingot. In addition, the thinner oxide layer reduces the heat conduction resistance through the ingot surface to the coolant. The modified ingot surface condition also enhances boiling heat transfer rate. A suitable oxidation inhibitor for including in the coolant can be a phosphate such as tetrapotassium pyrophosphate.

A complete understanding of the invention will be obtained from the following description when taken in connection with the accompanying drawing figures wherein like reference characters identify like parts or steps throughout.

DETAILED DESCRIPTION OF THE PREFERRED EMBODIMENTS

Figure 1:
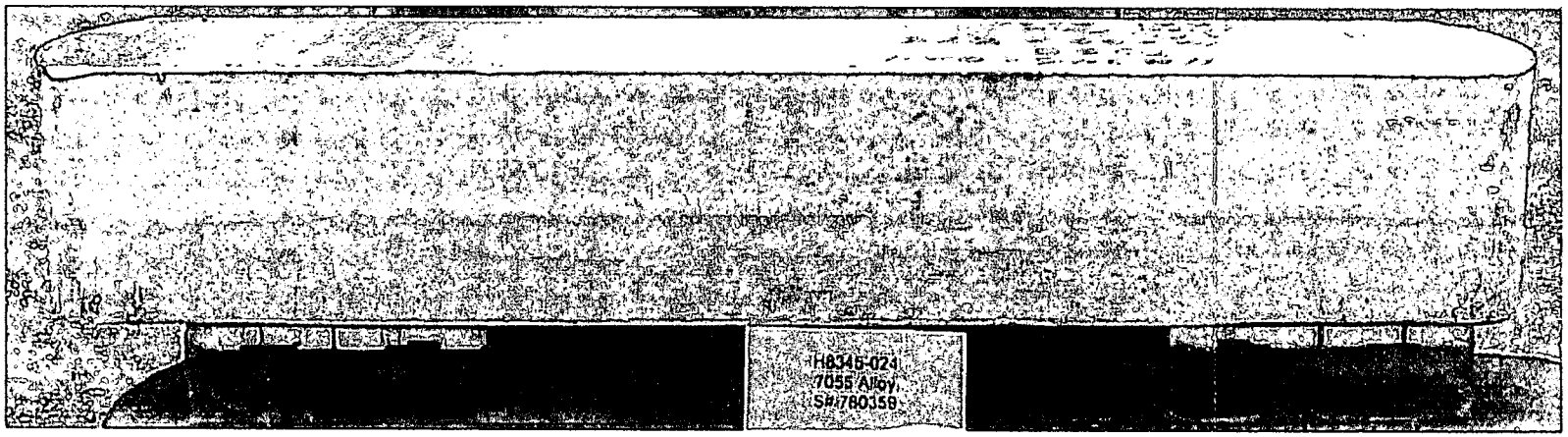
FIG. 1 is a computer generated drawing of a section of an ingot of AA 7055 produced in part according to the present invention.

For purposes of the description hereinafter, the terms "upper", "lower", "right", "left", "vertical", "horizontal", "top", "bottom" and derivatives thereof relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. When referring to any numerical range of values, such ranges are understood to include each and every number and/or fraction between the stated range minimum and maximum.

The present invention is directed to a method of direct chill casting a light metal ingot and the product produced thereby. Non-limiting examples of light metals which may be used with the method of the present invention include aluminum, magnesium and alloys thereof. The method of the present invention may be utilized with a conventional direct chill casting apparatus. In use of such an apparatus, molten metal is delivered to a top of a direct chill mold and a solidified shell of metal forms in contact with the mold. A coolant is applied to the surface of the shell as it emerges from the bottom portion of the mold and ultimately a solidified ingot is withdrawn.

According to the present invention, the coolant contains an oxidation inhibitor for increasing the rate of heat transfer from the solidifying metal compared to a coolant not containing the oxidation inhibitor. The coolant is typically water; however, this is not meant to be limiting. The oxidation inhibitor should be a compound which is dispersed in or soluble in the coolant (e.g. water soluble) and which passivates the surface of the solidifying shell of metal to prevent oxidation of the surface. For example, when the metal is an aluminum alloy the oxidation inhibitor prevents or minimizes the formation of the aluminum oxide on the surface of the ingot. As such the ingot appears as a "bright"

ingot having surfaces that contain a higher concentration of aluminum alloy with a minimal amount of aluminum oxide thereon.

Suitable oxidation inhibitors are those which passivate the surface of the ingot. One suitable class of oxidation inhibitors is phosphate compounds, such as tetrapotassium pyrophosphate. For tetrapotassium pyrophosphate, the concentration of the oxidation inhibitor in the aqueous coolant may be about 1 to about 10 parts per million (ppm). Other oxidation inhibitors may be used in the method of the present invention. Oxidation inhibitors can be used as corrosion inhibitors to produce corrosion resistant coatings to protect processing equipment. For example, corrosion inhibitors are applied as a coating to the internal surfaces of water treatment equipment to protect the equipment from internal corrosion. The present invention incorporates an oxidation/corrosion inhibitor directly onto an ingot during formation of the ingot. While conventionally, a corrosion inhibitor is applied to a piece of equipment to protect that equipment from corrosion, the present invention incorporates the oxidation/corrosion inhibitor directly into a process which produces a product that incorporates the oxidation inhibitor.

Accordingly, the present invention also includes metal ingots produced according to the method of the present invention. More particularly, the present invention includes an aluminum alloy ingot produced by direct chill casting a molten aluminum alloy using an aqueous coolant containing an oxidation inhibitor. The resulting ingot has a bright surface which is not producible according to conventional DC casting. Moreover, the bright surface of the ingot includes the oxidation inhibitor such as tetrapotassium phosphate.

A significant advantage of the present invention is that the heat transfer rate from the ingot is increased. By minimizing the formation of oxide on the surface and modifying the surface condition of the ingot, the rate of heat transfer from the ingot is faster compared to ingots produced without the oxidation inhibitor. The increased rate of heat transfer increases the ingot solidified shell thickness, strengthens the ingot shell and decreases the cracking tendency of the ingots.

Although the invention has been described generally above, the following particular examples give additional illustrations of the products and processes that are typical of the present invention.

EXAMPLES

Example 1

Figure 2:
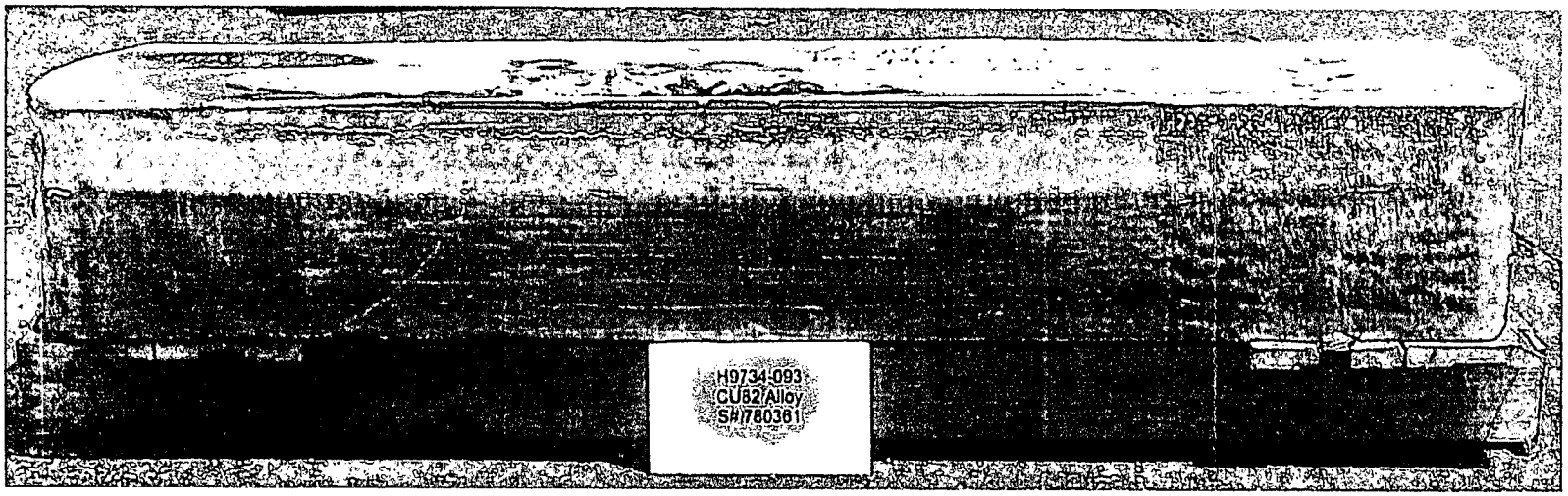
FIG. 2 is a computer generated drawing of a section of an ingot of AA 2124 (CU82) produced in part according to the present invention.
Figure 3:
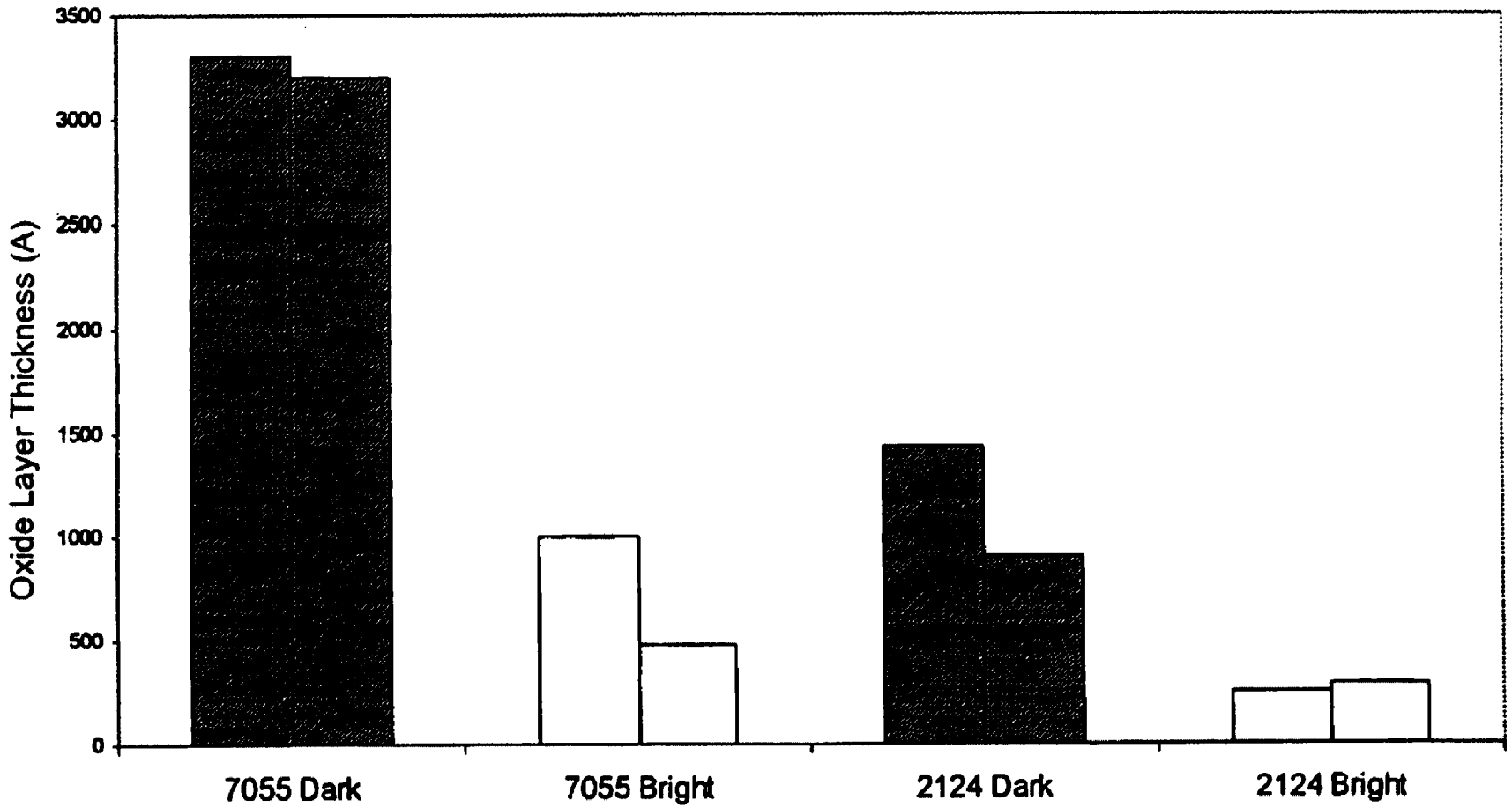
FIG. 3 is a bar graph of the thickness of the aluminum oxide layers produced in the ingots of FIGS. 1 and 2.

A melt of aluminum alloy 7055 of the Aluminum Association (AA) was direct chill cast using an aqueous coolant containing 3 ppm tetrapotassium phosphate during a portion of the casting process. An ingot of alloy AA 2124 was produced in a similar maimer. In both instances, the casting was performed using water available in the casting plant as the coolant and was then switched to a coolant containing 3 ppm tetrapotassium pyrophosphate. FIGS. 1 and 2 are computer generated drawings of a portion of the ingots produced of alloy 7055 and alloy 2124 (labeled as CU82). In both instances, the ingot exhibits a bright portion and a dark portion. The bright portion was cast when the coolant contained the oxidation inhibitor, and the dark portion of the ingot was produced when the coolant was water alone. The thickness of the oxide layers of the ingots was measured is shown in FIG. 3 for two locations in each of the dark portion and the bright portion of the ingots. In both instances, it is apparent that the oxide layer is significantly thinner in the bright portion of the ingot than in the dark portion of the ingot.

Example 2

Figure 4:
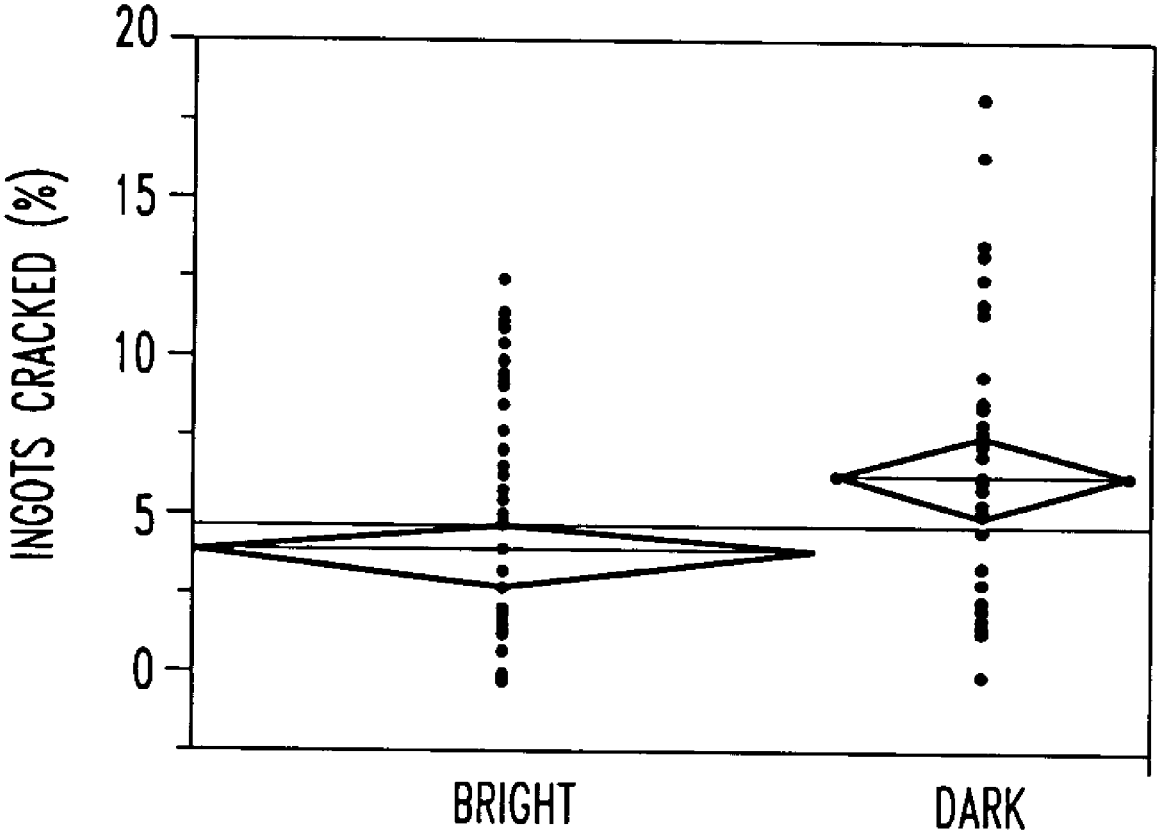
FIG. 4 is a graph of the percent ingots which cracked when produced according to the present invention and when produced via conventional DC casting.

Aluminum ingots were produced over a four-month period using the method of the present invention and using a conventional method of water as a coolant. FIG. 4 is a graph of the percent of bright ingots which cracked in production runs for ingots produced according to the present invention and the percent dark ingots which cracked in production runs operated according to the prior art. FIG. 4 also shows the results of a one way analysis of variance (ANOVA) for the data sets including the mean percent of ingots cracked indicated by the horizontal line within each data set and the 95% confidence interval for the mean. The mean percent of bright ingots which cracked was 4% and the mean percent of dark ingots which cracked was over 6% with distinct confidence intervals indicated by the horizontal line spanning the graph.

Example 3

Figure 5:
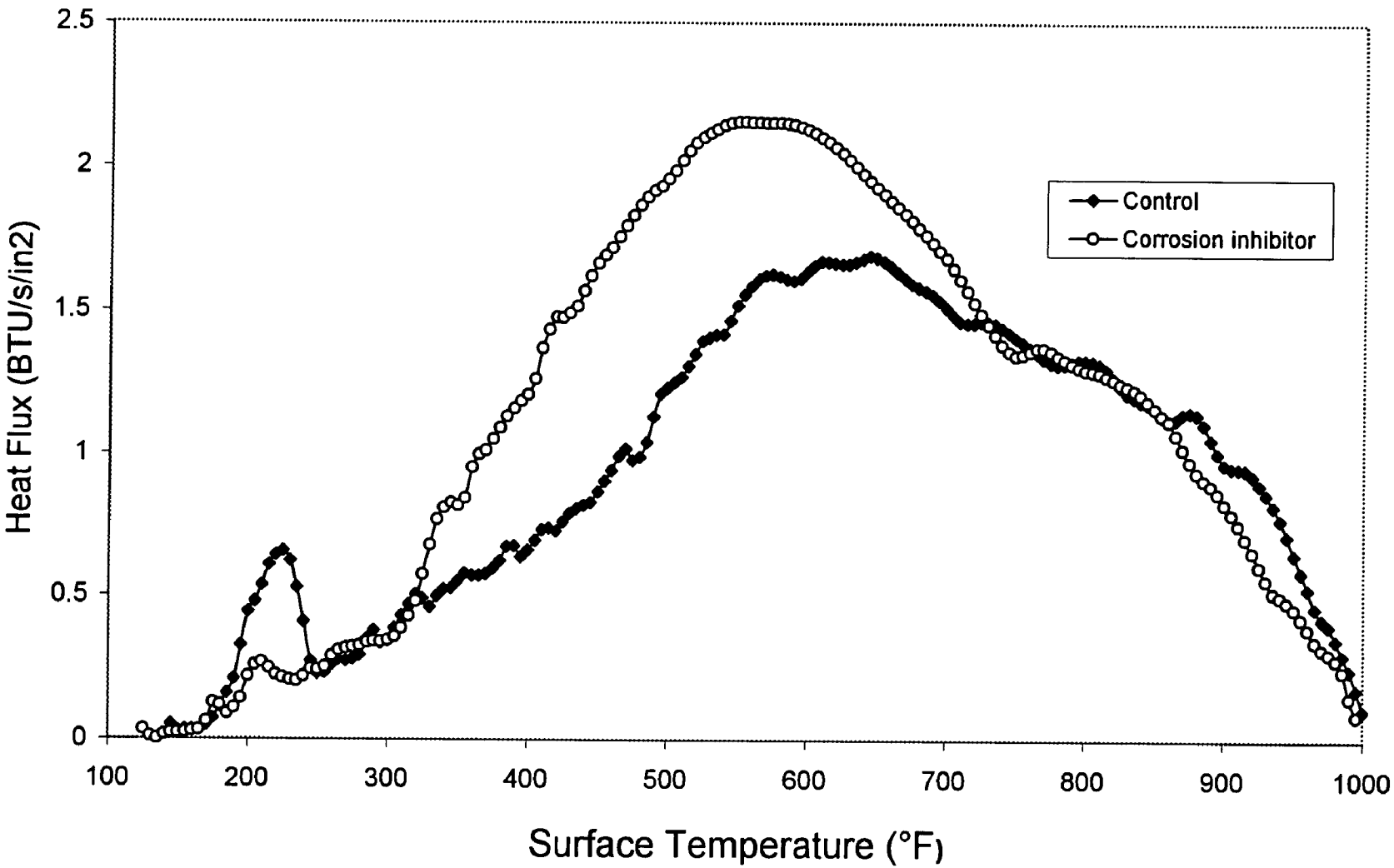
FIG. 5 is a graph of the heat flux versus surface temperature of an ingot produced according to the present invention and an ingot produced via conventional DC casting.

In order to simulate and determine the rate of heat transfer from aluminum alloy samples treated with an oxidation inhibitor according to the present invention, samples of 7055 alloy were produced sized about 7 inches long and 2 inches in diameter. The as-cast 7055 alloy samples had a shiny appearance. The samples were heated to a temperature above 1000° F. and quenched in a solution of 3 ppm tetrapotassium pyrophosphate in coolant water and in coolant water (no oxidation inhibitor) as a control. Upon quenching the 7055 alloy in coolant water containing the oxidation inhibitor, the shiny surface of the sample remained. However, when a sample was quenched in coolant water alone, the sample surface was significantly dulled and lost its bright appearance. The quenching of the 7055 alloy samples was performed three times each in coolant water and in coolant water with oxidation inhibitor. The heat flux from the quenched samples was determined and is shown in FIG. 5 as a function of surface temperature of the samples. It is apparent that the heat transfer from the samples bearing the oxidation inhibitor on their surfaces is significantly greater than that of the control samples.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. In a method of casting a metal ingot comprising the steps of delivering molten metal to a direct chill mold, forming a solidified shell of metal, applying a coolant to a surface of the shell as it emerges from the mold, and withdrawing a solidified ingot from the mold, the improvement comprising:

the coolant containing an oxidation inhibitor for increasing the rate of heat transfer from the solidifying metal compared to a coolant not containing the oxidation inhibitor to produce an ingot which is resistant to cracking.

2. The method of claim 1 wherein the metal is an alloy of aluminum or magnesium.

3. The method of claim 2 wherein the coolant comprises water.

4. The method of claim 3 wherein the metal is an aluminum alloy and the oxidation inhibitor prevents or minimizes the formation of aluminum oxide on the surface of the ingot.

5. The method of claim 4 wherein the oxidation inhibitor comprises a phosphate compound.

6. The method of claim 5 wherein the phosphate compound comprises tetrapotassium pyrophosphate.

7. The method of claim 6 wherein the concentration of tetrapotassium pyrophosphate in the coolant is about 1 to about 10 ppm.

8. The method of claim 3 wherein the aluminum alloy is alloy of an Aluminum Association series selected from the group consisting of 1000, 2000, 3000, 4000, 5000, 6000, 7000 and 8000.

9. The method of claim 3 wherein the aluminum alloy is alloy of an Aluminum Association series 2000 or 7000.

* * * * *